US005102508A

United States Patent [19]

Bartkowski et al.

[11] Patent Number: 5,102,508

[45] Date of Patent: Apr. 7, 1992

[54] METHOD OF PRODUCING COLORED SURFACES ON PARTS OF ALUMINUM OR ALUMINUM ALLOY

[75] Inventors: Klaus D. Bartkowski, Krefeld; Peter Venn, Wuppertal, both of Fed. Rep. of Germany

[73] Assignee: Gebr. Happich GmbH, Fed. Rep. of Germany

[21] Appl. No.: 528,130

[22] Filed: May 23, 1990

[30] Foreign Application Priority Data

May 26, 1989 [DE] Fed. Rep. of Germany ..... 3917188

[51] Int. Cl.[5] ..... C25D 5/44; C25D 11/04; C25F 3/20

[52] U.S. Cl. ..... 205/173; 204/129.35; 204/129.95; 205/202; 205/213; 205/220; 205/329

[58] Field of Search ..... 204/37.6, 33, 38.3, 204/42, 58, 129.35, 129.95

[56] References Cited

U.S. PATENT DOCUMENTS

| | | | |
|---|---|---|---|
| 2,647,865 | 8/1953 | Freud | 204/33 |
| 3,166,444 | 1/1965 | Ehren et al. | 204/33 |
| 3,257,244 | 6/1966 | Barkman | 204/37.6 |
| 3,365,380 | 1/1968 | Shibasaki et al. | 204/129.95 |
| 3,818,566 | 6/1974 | Anerseon et al. | 204/58 |
| 4,070,255 | 1/1978 | Hasegawa et al. | 204/37.6 |
| 4,152,222 | 5/1979 | Sheasby et al. | 204/37.6 |
| 4,244,791 | 1/1981 | Paulet et al. | 204/37.6 |
| 4,256,546 | 3/1981 | Brugger | 204/33 |
| 4,288,299 | 9/1981 | Carter | 204/37.6 |
| 4,430,168 | 2/1984 | Gazapo Santa-Olalla et al. | 204/37.6 |
| 4,440,606 | 4/1984 | Powers et al. | 204/37.6 |
| 4,445,983 | 5/1984 | Gohausen et al. | 204/37.6 |
| 4,531,979 | 7/1985 | Bohler et al. | 204/37.6 |
| 4,647,347 | 3/1987 | Schoener et al. | 204/37.6 |
| 4,648,911 | 3/1987 | Grüninger | 204/37.6 |
| 4,756,771 | 7/1988 | Brodalla et al. | 148/272 |
| 4,995,951 | 2/1991 | Venn | 204/129.95 |
| 5,009,756 | 4/1991 | Bartkowski et al. | 204/129.35 |

FOREIGN PATENT DOCUMENTS

| | | |
|---|---|---|
| 58-153800 | 9/1983 | Japan . |
| 606240 | 8/1948 | United Kingdom . |
| 657428 | 9/1949 | United Kingdom . |
| 1569101 | 6/1980 | United Kingdom . |
| 2137657 | 10/1984 | United Kingdom . |

OTHER PUBLICATIONS

Hübner, W. and Schiltknetcht, A., "The Practical Anodizing of Aluminum", McDonald and Evans, London, 1960, pp. 7-9, 31-35, 40-41, 66-69 and 76-91.

Silman, Isserlis, Averill, "Protective and Decorative Coatings for Metals", Finishing Publications, England, 1978, p. 461.

Lowenheim, F. A., "Electroplating", McGraw-Hill, Inc., New York, 1978, pp. 466-467.

Wernick et al, "The Surface Treatment and Finishing of Aluminum and its Alloys", Fifth edition, vol. 1, pp. 73-77, 169-170, 210, 409-410, 522-543, 606-608, 736 (1987).

*Primary Examiner*—John Niebling
*Assistant Examiner*—Kishor Mayekar
*Attorney, Agent, or Firm*—Ostrolenk, Faber, Gerb & Soffen

[57] ABSTRACT

A method is described for producing colored surfaces on parts of aluminum or aluminum alloy which is characterized by the following process steps:

1. The parts are pre-treated by degreasing or cleaning,
2. The parts are electrolytically anodically/alkalinely brightened,
3. The parts are electrolytically anodized with the use of direct current,
4. The parts are electrolytically and/or organically colored, and
5. The oxide layer on the parts is compacted.

9 Claims, No Drawings

METHOD OF PRODUCING COLORED SURFACES ON PARTS OF ALUMINUM OR ALUMINUM ALLOY

BACKGROUND OF THE INVENTION

The present invention refers to a method of producing colored surfaces on parts of aluminum or aluminum alloy.

Aluminum parts, such as aluminum stampings or rolled sections are used, inter alia, in the hardware and lighting industries or, in particular, also in automobile manufacture, for instance, for window mounting systems or else as ornamental frames, ornamental moldings and the like. In this connection, it is also known to use parts of aluminum or aluminum alloy which have a colored anodized surface.

The object of the present invention is to provide a new method of producing colored surfaces on aluminum or aluminum- alloy parts in which the parts which are colored by this method have the following quality features:

a) 1,000-hour light-fastness testing without fading and without change in the color pigmentation. Testing: Xenotest Hot Light Exposure 450 DIN 75202.

b) 6 cycles Kesternich DIN 50018 Testing for corrosion resistance c) 5,000 strokes—Testing of fastness to rubbing without change of surface according to Veslick DIN 53339.

The new method is also characterized by the fact that multiplicity of colors with color gradations viz gold - bronze
light - dark bronze
gray - brown
gray - blue
anthracite
light - dark blue
blue - violet is made possible on coloring of the parts as well. The new method also allows for a simple verification of the results of the coloring and reproduceability at all times of the individual shades of color.

SUMMARY OF THE INVENTION

The objects of the invention are accomplished by subjecting aluminum or aluminum alloy parts to a sequence of steps comprising:

(1) pretreating the parts by degreasing or cleaning. This may be suitably accomplished by first treating the parts in an aqueous alkaline phosphate- and borate-containing solution and then treating the parts in an acid solution containing phosphoric acid;

(2) electrolytically anodically/alkalinely brightening the parts, as by subjecting them to direct current in an alkaline electrolyte containing $NaPO_4$, $Na_2Co_3$, $AlPO_4$ and beechwood extracts;

(3) electrolytically anodizing the parts to produce an oxide layer, with the use of direct current, suitably in an electrolyte containing $H_2SO_4$, Al and a surfactant;

(4) electrolytically and/or organically coloring the parts. Such coloring may suitably be accomplished by first subjecting the parts to an alternating current in an electrolyte containing $SnSO_4$, $H_2SO_4$ and an oxycarboxylic or sulfonic acid, preferably an aromatic sulfonic acid, for example, benzene sulfonic acid, and then treating the parts in an acid dyebath containing an azo dyestuff and a fungicide;

(5) compacting the oxide layer on the parts. This may be accomplished by first treating the parts in a solution containing cobalt and nickel fluorides in desalinated water and then treating the parts in desalinated water containing a coating inhibitor such as a triazine derivative, preferably a 1,3,5-triazine such as isocyanuric acid.

Between steps (2) and (3) the parts are preferably washed with water, exposed to a chromic acid solution and then washed in a sodium hydrosulfite solution.

DESCRIPTION OF THE PREFERRED EMBODIMENTS

Preferred examples of a surface treatment of a part in order to obtain the desired quality features will be explained in detail below.

An extruded section of aluminum alloy AlMg 1 or AlMgSi 0.5 is mechanically ground and polished. Degreasing or cleaning is effected in two steps, namely:

1. Treatment by an aqueous solution of an alkaline phosphate and borate, pH 9.

1.1. Treatment by an acidic phosphoric acid containing aqueous solution, pH 1.1.

2. After the degreasing and cleaning steps, the section is subjected electrolytically to alkaline brightening in order to obtain a sufficiently bright surface reflection.

The electrolyte employed in this step contains:

| | |
|---|---|
| $Na_3PO_4$ (trisodium phosphate) | 120 g/l |
| $Na_2CO_3$ (disodium carbonate) | 330 g/l |
| $AlPO_4$ (aluminum phosphate) | 10 g/l |
| Beechwood extracts | 5 m/l |

The electrolysis conditions are as follows:

| | |
|---|---|
| Current density | 3 amp/dm$^2$ |
| Operating temperature | 70–80° C. |
| Exposure time | 18 minutes |

2.2. After the brightening step, the aluminum alloy which has been treated in this manner is washed in water. The oxide film formed in the brightening is then removed in a chromic acid solution of 50 g/l $CrO_3$ at 98° C. with an exposure time of 3 minutes.

2.3. In a further process step, the aluminum alloy is washed in a sodium hydrosulfite solution in order to reduce the hexavalent chromium to trivalent chromium.

3. The aluminum alloy section is then electrolytically anodized with the use of direct current.

The electrolyte employed in this step contains:

| | |
|---|---|
| $H_2SO_4$ (sulfuric acid) | 180 g/l |
| Al | 8 g/l |
| Surfactant (wetting agent) | 30 ml |

The anodizing conditions are as follows:

| | |
|---|---|
| Current density | 1.5 amp/dm$^2$ |
| Operating temperature | 18–20° C. |
| Exposure time | 35 minutes |
| Anodic layer thickness | 12 μm |

4. In the next process step of the coloring process, the section is exposed in an electrolyte containing a metal salt and subjected to an alternating current. Gold-bronze and light-dark bronze shades are obtained under the same operating conditions when using different exposure times.

The electrolyte employed in this step contains:

| | |
|---|---|
| $SnSO_4$ (tin sulfate) | 15 g/l Sn (tin as tin sulfate) |
| $H_2SO_4$ (sulfuric acid) | 15 g/l |
| Benzene sulfonic acid | 30 ml/l |

The operating conditions are as follows:

| | |
|---|---|
| Operating temperature | 20–22° C. |
| Current density | 1.5 amp/dm$^2$ |
| pH | 1.0 |

In the cathodic alternating current phase, tin is incorporated into the pores of the oxide layer by electrolytic metal deposition.

The gold-bronze and light-dark bronze shades are obtained with variable current densities and different exposure times of 10 to 15 minutes.

If the section is to be imparted a shade other than the one described previously, then the exposure time upon the deposition of the metal is limited to 10–30 seconds, variable current densities giving different color gradations. By this parameter-controlled metal deposition a basic coloring is obtained, the adsorbability of the oxide layer being further retained.

4.1. In another coloring treatment, the adsorbability of the oxide layer is utilized in order variably to change the basic color by chemical incorporation of an organic azo dyestuff.

The chemical dyebath employed in this procedure contains:

| | |
|---|---|
| Azo dye | 1 g/l |
| Fungicide | 0.4 ml/l |

The operating conditions are as follows:

| | |
|---|---|
| pH | 3.5–3.9 |
| Operating temperature | 50° C. |
| Exposure times | 90–180 seconds |

With different times of exposure in the chemical dyebath, the shades gray-brown, gray-blue, anthracite, light-dark blue, and blue-violet are obtained.

In the adsorption process, pigment parts of the azo dyestuff deposit, in addition to the previously deposited metal salt, into the pores of the oxide layer and thus change the basic color.

5. Finally, the oxide layer is compacted in two process steps and is thus protected against external influences.

In the first of these steps the section is pre-treated for about 10 minutes at about 30° C. in a solution of 6% cobalt fluoride and 30% nickel fluoride in completely desalinated water.

In this connection, the following basic reaction between the oxide layer and the nickel fluoride takes place:

$$Al_2O_3 + Ni^2 + F + H_2O \xrightarrow{30^\circ C.}$$

-continued $$Al(OH)F_2 + Ni(OH)_2 + OH + AlF$$

In this first step, a consistent precompacting of the oxide layer is obtained.

In the second step, the section is treated for 50 minutes at 70° C. in completely desalinated water with the addition of a coating inhibitor consisting of 2 ml/l of isocyanuric and in this connection, a chemical reaction takes place first of all with the binding of the water ti ($Al_2O_3 + H_2O \rightarrow 2\ AlO + OH$).

The increase in volume of the layer produces a closing of the pores. The layer is now protected from external influences.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of producing colored surfaces on parts of aluminum or aluminum alloy, comprising:

(1) pretreating said parts by degreasing or cleaning;

(2) electrolytically anodically/alkalinely brightening said parts;

(3) washing said parts with water, exposing them to a chromic acid solution and then washing them in a sodium hydrosulfite solution;

(4) electrolytically anodizing said parts with the use of direct current;

(5) coloring said parts; and (6) compacting the oxide layer of said parts;

wherein:

step (1) is carried out by first treating said parts in an alkaline phosphate-and borate-containing aqueous solution and then treating said parts in an acid solution containing phosphoric acid;

step (2) is carried out by subjecting said parts to direct current in an alkaline electrolyte containing $Na_3PO_4$, $Na_2CO_3$, $AlPO_4$ and beechwood extracts;

step (4) is carried out in an electrolyte comprising $H_2SO_4$, Al and a surfactant;

step (5) is carried out by first subjecting said parts to an alternating current in an electrolyte comprising $SnSO_4$, $H_2SO_4$ and an oxycarboxylic or sulfonic acid, and then treating said parts in an acid dyebath comprising an azo dyestff and a fungicide; and step (6) is carried out by first treating said parts in a solution comprising cobalt fluoride and nickel fluoride in desalinated water and then treating said parts in desalinated water containing a coating inhibitor.

2. A method according to claim 1, wherein step (1) is carried out by first pretreating said parts in an alkaline phosphate- and borate-containing aqueous solution of pH 9 and then treating said parts in an acid solution of pH 1.1 containing phosphoric acid.

3. A method according to claim 1, wherein in step (2) said parts are treated in an alkaline electrolyte having the composition:

| | |
|---|---|
| $Na_3PO_4$ | 120 g/l |
| $Na_2CO_3$ | 330 g/l |

-continued

| | |
|---|---|
| $AlPO_4$ | 10 g/l |
| beechwood extracts | 5 ml/l |

and subjected to direct current at a current density of 3 amp/dm$^2$, an operating temperature of 70°-80° C. and a exposure time of about 18 minutes.

4. A method according to claim 1 wherein in step (3) said parts are washed with water, then exposed to a chromic acid solution containing about 50 g/l of $CrO_3$ at about 98° C. for about 3 minutes, and then washed in a sodium hydrosulfite solution.

5. A method according to claims 1, wherein in step (4) said parts are treated in an electrolyte of the composition

| | |
|---|---|
| $H_2SO_4$ | 180 g/l |
| Al | 8 g/l |
| surfactant | 30 ml |

at a current density of 1.5 amp/dm$^2$, an operating temperature of 18°-20° C., and an exposure time of 35 minutes.

6. A method according to claim 1, wherein in a first stage of step (5), said parts are treated in an electrolyte which contains metal salt, having the composition

| | |
|---|---|
| $SnSO_4$. | 15 g/l Sn (tin as tin sulfate) |
| $H_2SO_4$ | 15 g/l |
| benzene sulfonic acid | 30 ml/l |

at an operating temperature of 20°-22° C., a current density of 1.5 amp/dm$^2$ and a pH of 1.0, with the use of alternating current.

7. A method according to claim 1, wherein in a second stage of step (5) said parts are treated in a chemical dyebath having the composition

| | |
|---|---|
| azo dyestuff | 1 g/l |
| fungicide | 0.4 ml/l |
| pH | 3.5-3.9 |

at an operating temperature of about 50° C. and exposure time of 90-180 seconds.

8. A method according to claim 1, wherein said oxide layer is compacted in step (6) by first treating said parts in a solution containing about 6% cobalt fluoride and about 30% nickel fluoride in completely desalinated water at about 30° C. for about 10 minutes and then treating said parts in completely desalinated water with the addition of a coating inhibitor consisting of about 2 ml/l of a triazine derivative at an operating temperature of about 70° C. for about 50 minutes.

9. A method according to claim 8, wherein said triazine derivative is a 1,3,5 triazine derivative.

* * * * *